US009599336B1

(12) United States Patent
Yu et al.

(10) Patent No.: US 9,599,336 B1
(45) Date of Patent: Mar. 21, 2017

(54) BURNER ASSEMBLY AND SYSTEM FOR HEATING DRYING AIR

(75) Inventors: Qinlai Yu, Morton Grove, IL (US); Stan Beinarauskas, Chicago Ridge, IL (US)

(73) Assignee: Midco International, Inc., Chicago, IL (US)

( * ) Notice: Subject to any disclaimer, the term of this patent is extended or adjusted under 35 U.S.C. 154(b) by 396 days.

(21) Appl. No.: 13/409,851

(22) Filed: Mar. 1, 2012

(51) Int. Cl.
*F23D 14/46* (2006.01)

(52) U.S. Cl.
CPC .... *F23D 14/46* (2013.01); *F23D 2900/21003* (2013.01)

(58) Field of Classification Search
CPC ..... F23D 5/10; F23D 2212/201; F23D 2212/103; F23D 14/125; F23D 2900/00019; F23D 2900/21003; F23D 2900/14064; F23D 14/14; F23D 14/145; F23D 14/18; F23D 14/46
USPC ... 126/104 R, 116 R, 231, 104 A, 39 E, 181, 126/182, 91 R; 431/302, 352, 226, 253, 431/329
See application file for complete search history.

(56) References Cited

U.S. PATENT DOCUMENTS 2,946,510 A * 7/1960 Galvin ..... 237/70
3,128,756 A * 4/1964 Galvin ..... 126/116 R
3,225,757 A * 12/1965 Keller ..... 126/91 R
3,312,269 A * 4/1967 Johnson ..... 431/328
3,603,711 A * 9/1971 Downs ..... F23D 11/24 431/170
4,231,735 A * 11/1980 Downs ..... 431/328
4,411,616 A * 10/1983 Neumann ..... 431/114
5,165,887 A * 11/1992 Ahmady ..... 431/329
H001197 H * 6/1993 Mank et al.
5,348,987 A 9/1994 Kato et al.
5,356,487 A * 10/1994 Goldstein et al. ..... 136/253
5,368,011 A * 11/1994 Bodner ..... 126/116 R
5,520,536 A * 5/1996 Rodgers et al. ..... 431/329
6,042,371 A * 3/2000 Mitani et al. ..... 432/179
6,558,153 B2 5/2003 Schutz et al.
6,725,811 B1 4/2004 Moore, Jr. et al.
6,929,470 B1 8/2005 Lifshits et al.
2005/0229921 A1* 10/2005 Krupp ..... B05B 15/1222 126/298

(Continued)

FOREIGN PATENT DOCUMENTS

CA 1147624 6/1983
GB 2448397 B * 6/2012

(Continued)

*Primary Examiner* — Steven B McAllister
*Assistant Examiner* — Steven Anderson, II
(74) *Attorney, Agent, or Firm* — Cook Alex Ltd.

(57) ABSTRACT

A burner assembly includes a blower assembly couplable to a source of fuel, and a longitudinally elongated housing having a lateral upstream edge, a lateral downstream edge, and a slot formed in the downstream edge. The housing encloses a combustion chamber comprising a generalized cylinder with cross-section having an arcuate portion and a straight portion, the arcuate portion defined by the lateral upstream and downstream edges of the housing. The burner assembly also includes an elongated burner head assembly, the elongated burner head assembly having a first end coupled to the blower and a second end disposed within the combustion chamber.

6 Claims, 5 Drawing Sheets

(56) References Cited

U.S. PATENT DOCUMENTS

2011/0041837 A1* 2/2011 Kato ..... F23C 3/002
126/91 R

FOREIGN PATENT DOCUMENTS

| | | |
|---|---|---|
| KR | 20030048233 | 6/2003 |
| KR | 100528242 | 11/2005 |
| KR | 100755389 | 9/2007 |
| KR | 20090084135 | 8/2009 |

* cited by examiner

BURNER ASSEMBLY AND SYSTEM FOR HEATING DRYING AIR

BACKGROUND

This patent is directed to a burner assembly and a system for heating drying air, and, in particular, to a burner assembly and a system for heating drying air that produces low nitrogen oxide (NOx) emissions.

When fuel, such as natural gas, is burned or combusted, emissions are produced. Emissions from the combustion of natural gas, for example, may include carbon monoxide, carbon dioxide, nitrogen oxides (NOx), volatile organic compounds (VOCs), sulfur dioxide and particulate matter.

As to NOx emissions, it is believed that the principal mechanism of formation in natural gas combustion is thermal. The thermal NOx mechanism occurs through the thermal dissociation and subsequent reaction of nitrogen and oxygen molecules in the combustion air. The thermal NOx mechanism is influenced by the peak temperature of combustion, and the time of exposure of the combustion air to the peak combustion temperature.

NOx emissions can have undesirable effects on humans and the environment. In humans, low levels of NOx emissions can cause nausea, irritated eyes and/or nose, fluid forming in lungs and shortness of breath. Higher levels can lead to rapid, burning spasms, swelling of the throat, reduced oxygen intake, and increased fluid formation. As to the environment, NOx pollution may help form acid rain, and may combine with other pollutants to form toxic chemicals.

Steps have been taken to reduce NOx emissions through governmental regulation. For example, there are standards on NOx emissions produced by motor vehicles. In addition, there are standards for NOx emissions produced by commercial activities that require the combustion of natural gas.

For example, natural gas is typically used to heat the air used in painting booths. This air typically is introduced into the painting booths in large volumes, at high flow rates and at high temperatures. Consequently, the burners used to heat the air must operate at high peak combustion temperatures so as to increase the large volumes of fast moving air to the appropriate temperature. This results in significant NOx emissions.

As set forth in greater detail below, the present disclosure sets forth an improved burner assembly and system embodying advantageous alternatives to the conventional devices and methods discussed above.

SUMMARY

In an aspect of the present disclosure, a burner assembly includes a blower assembly couplable to a source of fuel, and a longitudinally elongated housing having a lateral upstream edge, a lateral downstream edge, and a slot formed in the downstream edge. The housing encloses a combustion chamber comprising a generalized cylinder with cross-section having an arcuate portion and a straight portion, the arcuate portion defined by the lateral upstream and downstream edges of the housing. The burner assembly also includes an elongated burner head assembly, the elongated burner head assembly having a first end coupled to the blower and a second end disposed within the combustion chamber.

In another aspect of the present disclosure, a system for heating air includes a conduit having a first end and a second end, a blower in communication with the conduit to move air along the conduit between the first end and the second end, and a burner assembly disposed within the conduit between the first and second ends of the conduit. The burner assembly includes a blower assembly couplable to a source of fuel, and a longitudinally elongated housing having a lateral upstream edge, a lateral downstream edge, and a slot formed in the downstream edge. The housing encloses a combustion chamber comprising a generalized cylinder with cross-section having an arcuate portion and a straight portion, the arcuate portion defined by the lateral upstream and downstream edges of the housing. The burner assembly also includes an elongated burner head assembly, the elongated burner head assembly having a first end coupled to the blower and a second end disposed within the combustion chamber.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention. Moreover, it will be recognized that the system is scalable in size.

Figure 1:
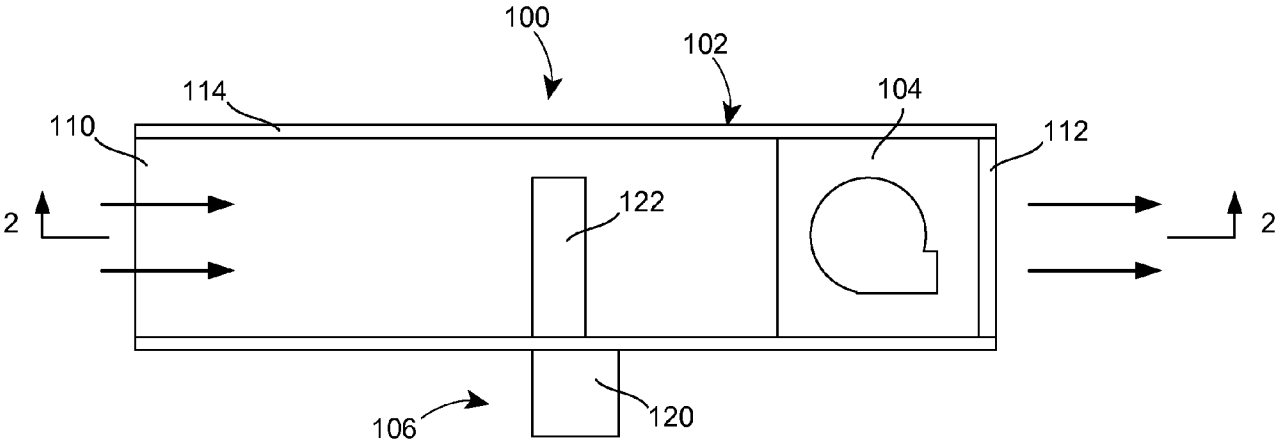
FIG. 1 is a plan view of a burner assembly according to the present disclosure in combination with a conduit or duct and a blower to move air (or other gasses) along the conduit, with the top of the conduit removed to better visualize the structures within the conduit that define the system of FIG. 1.
Figure 2:
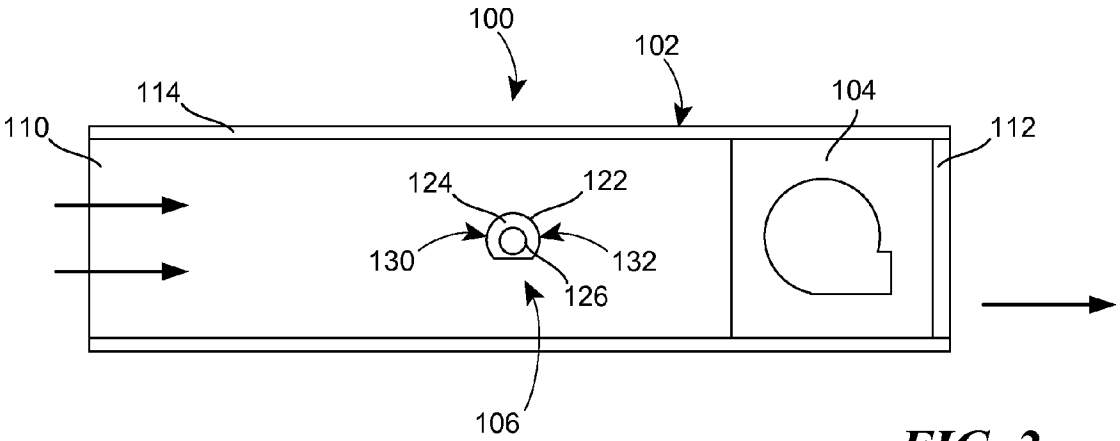
FIG. 2 is a cross-sectional view of the system of FIG. 1, taken alone line 2-2.

According to FIGS. 1 and 2, a system 100 for heating air is illustrated. The system 100 includes a conduit 102, a blower 104, and a burner assembly 106. According to an embodiment of the present disclosure, the conduit 102 may be connected to a painting booth, for example, to assist in the drying and curing of paint that has been applied to an object, such as a car, in the booth.

The conduit 102 has a first end 110 and a second end 112. While the conduit 102 is illustrated in FIGS. 1 and 2 as defined by a wall 114 of rectangular cross-section and defining a relatively linear path between the ends 110, 112, the conduit 102 may include any number of bends or curves between the first end 110 and the second end 112. In addition, the conduit 102 may be divided into a number of sections between, for example, the burner assembly 106 and the end 112, or between the end 110 and the burner assembly 106. The conduit 102 may also include access doors, dampers, etc.

Further, while the conduit 102 is illustrated as being used in connection with only the blower 104 and the burner assembly 106, other equipment may be disposed within the conduit 102 as well. For example, equipment may be introduced to dehumidify the air or to remove particulates from the air. Moreover, the number of blowers or burner assemblies used may be greater than that illustrated in FIGS. 1 and 2.

The blower 104 is illustrated in communication with the conduit 102, and operates to move a gas (e.g., air) along the conduit 102 between the first end 110 and the second end 112. The blower 104 may be disposed downstream of the burner assembly 106, as illustrated, to draw air through the conduit 102, in a "pull through" system. Alternatively, the blower 104 may be disposed upstream of the burner assembly 106 to force air through the conduit 102 instead, in a "push through" system. The blower 104 may be referred to as a fan, and according to certain embodiments may take the form of a centrifugal fan (or blower). The blower 104 may move air through the conduit at 8000 to 15,000 CFM.

The burner assembly 106 is disposed within the conduit 102 between the first and second ends 110, 112 of the conduit 102. The burner assembly 106 is used to heat the air passing through the conduit 102 between the ends 110, 112. This is achieved by heat transfer occurring between the surface of the burner assembly 106 and the air passing through the conduit 102. The heating of the air passing through the conduit 102 may also be achieved through mixing of the exhaust gases from the burner assembly 106 and the air passing through the conduit 102 downstream of the burner assembly 106 (i.e., in the portion of the conduit 102 between the burner assembly 106 and the end 112 of the conduit 102).

Figure 3:
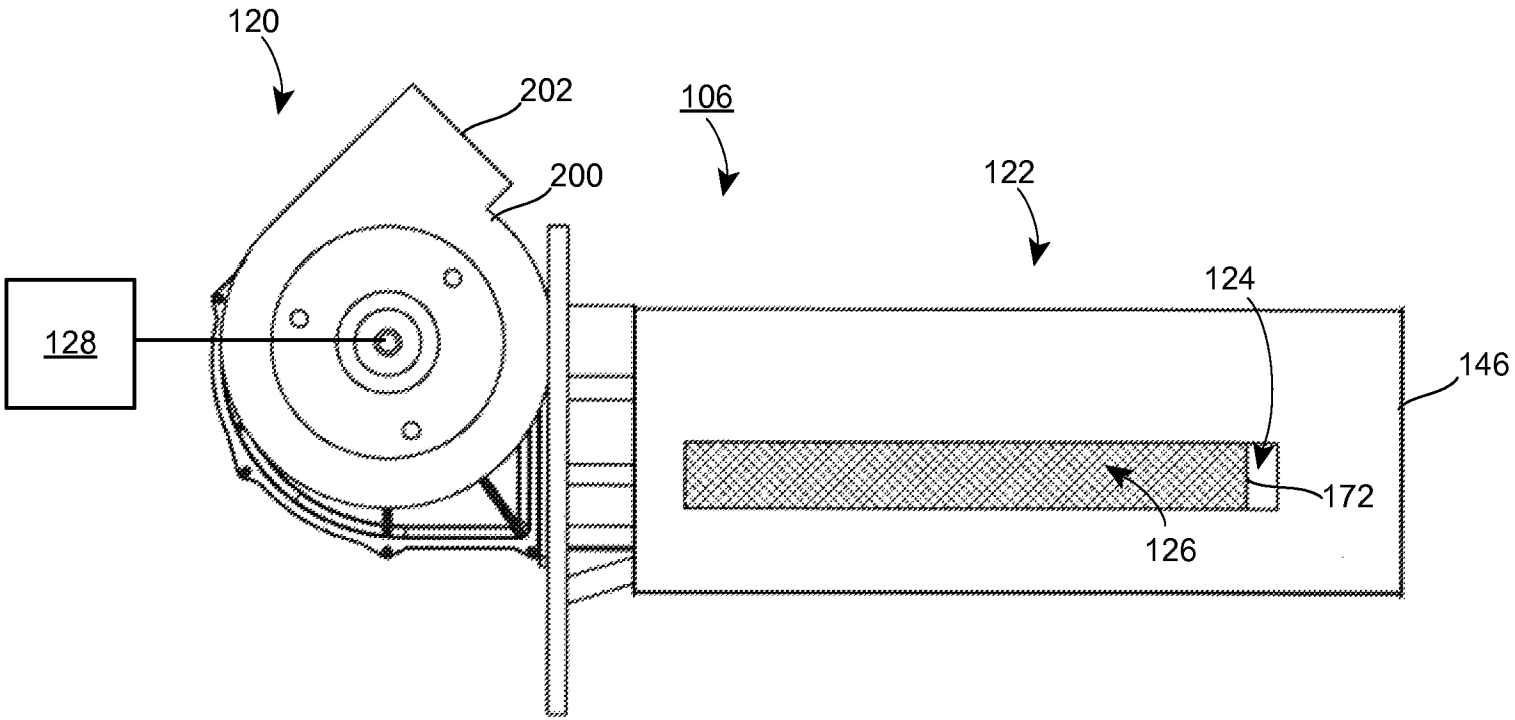
FIG. 3 is a perspective view of a burner assembly according to the present disclosure for use in the system of FIG. 1.
Figure 5:
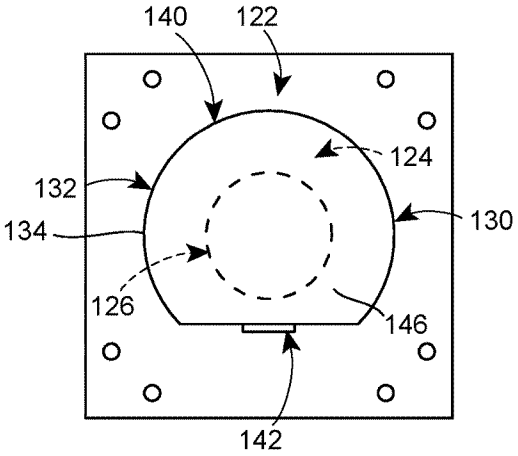
FIG. 5 is an end view of the housing of FIG. 4.
Figure 4:
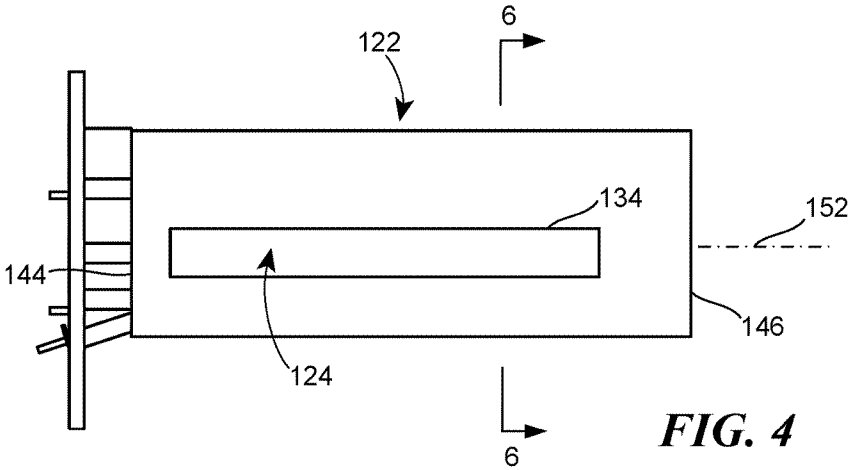
FIG. 4 is a side view of a housing for use in the burner assembly of FIG. 3, viewing the housing looking upstream at the downstream side or edge of the burner assembly.
Figure 6:
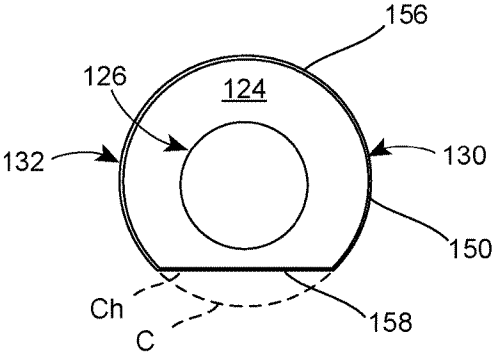
FIG. 6 is a cross-sectional view of the housing of FIG. 4, taken along line 6-6.
Figure 7:
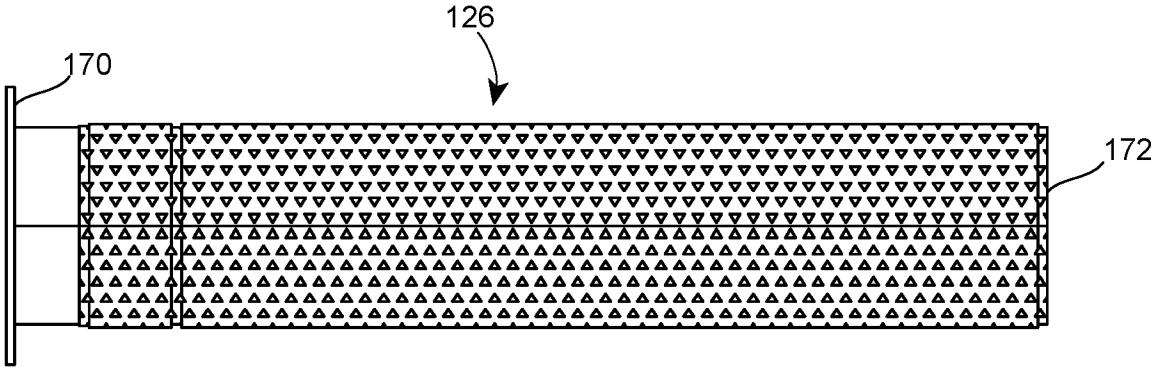
FIG. 7 is a side view of a burner head assembly for use in the burner assembly of FIG. 3.
Figure 8:
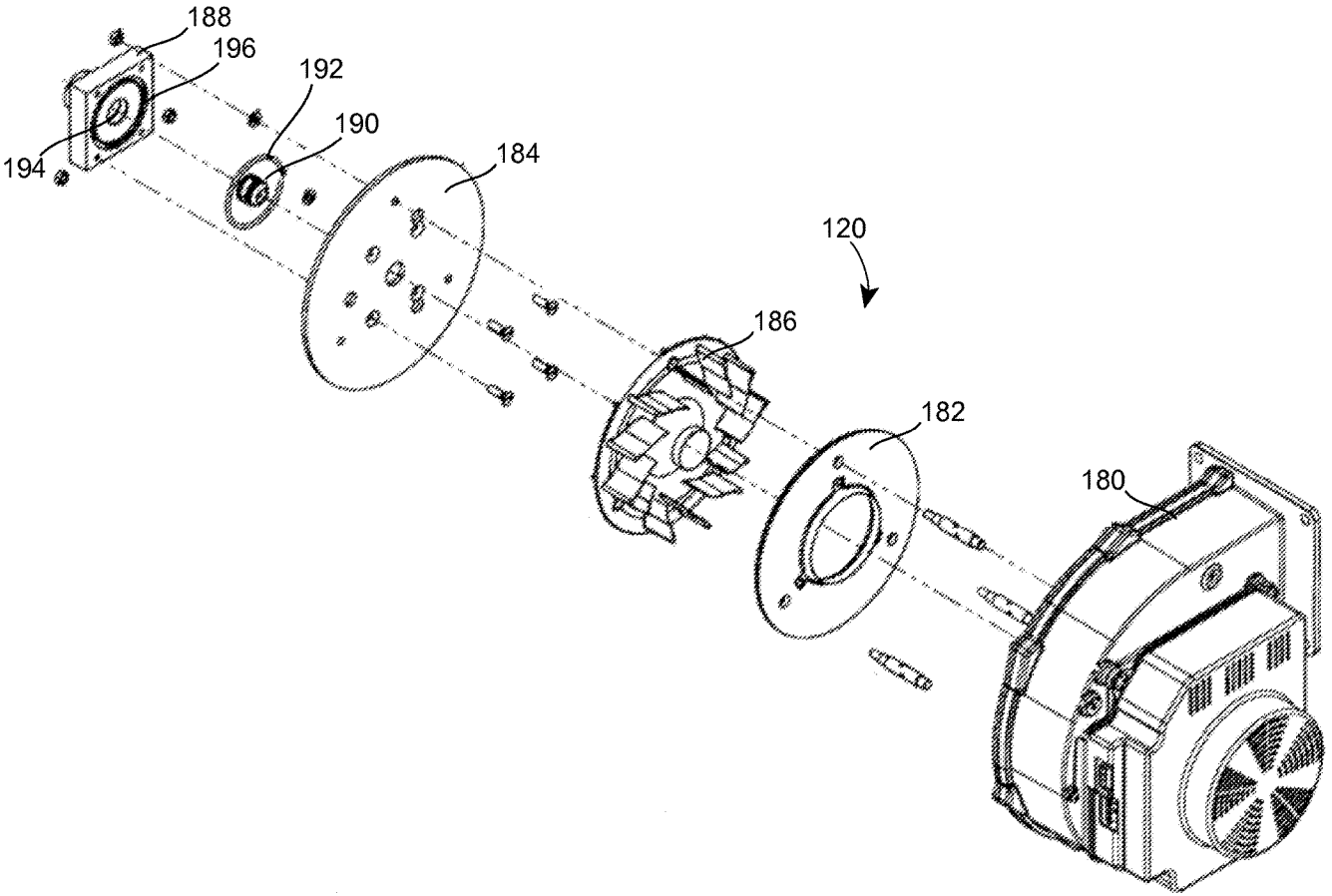
FIG. 8 is an exploded cross-sectional view of a blower assembly for use in the burner assembly of FIG. 3.

The burner assembly 106 includes a blower assembly 120, a housing 122 enclosing a combustion chamber 124, and a burner head assembly 126 disposed in the combustion chamber 124. The elements of the burner assembly 106 are illustrated as assembled and in place within the conduit 102 in FIGS. 1 and 2, as assembled but separated from the conduit in FIG. 3, and as individual elements in FIGS. 4-8. In particular, the housing 122 is illustrated in FIGS. 4-6 (in conjunction with the burner head assembly 126 in FIGS. 5 and 6), the burner head assembly 126 is illustrated in FIG. 7, and the blower assembly 120 is illustrated in FIG. 8.

The burner assembly 106 may provide a low NOx emission through the use of low-flame combustion at the burner head assembly 126 achievable because the housing 122 shields the burner head assembly 126 from the high flow rate air stream passing through the conduit 102. At the same time, the housing has a profile that may minimize disruption of the air flow through the conduit 102 and the noise produced by the burner assembly 106. As a consequence, low NOx emission may be provided in conjunction with minimal disruption of air flow and noise produced according to certain embodiments.

To provide this low-flame combustion, the burner assembly 106 must be supplied with the materials for combustion: oxygen (such as may be obtained from air) and fuel. In particular, the blower assembly 120 is used to introduce a fuel/air mixture into the burner head assembly 126. To this end, the blower assembly 120 is couplable to a source of fuel 128, as illustrated in FIG. 3. According to certain embodiments, the fuel used for combustion may be natural gas, which is principally methane, but may include other combustible gases (e.g., ethane) as well. In fact, the burner assembly 106 may be used with a variety of combustible gaseous fuels, and not simply natural gas (alone or in combination with other combustible gases). The blower assembly 120 is also connected to a source of oxygen (e.g., the air), as will be explained in greater detail below.

Having thus described the structure and function of the burner assembly 106 in general terms, it is now described in particular detail, starting with FIGS. 3-6. The housing 122 is a longitudinally elongated housing having a lateral upstream edge 130, a lateral downstream edge 132, and a slot 134 formed in the downstream edge 132. As mentioned previously, the housing 122 encloses the combustion chamber 124 (see, e.g., FIGS. 3, 5 and 6). In general terms, the chamber 124 is in the shape of a generalized cylinder with cross-section having an arcuate portion 140 and a straight portion 142, the arcuate portion 140 defined by the lateral upstream and downstream edges 130, 132 of the housing 122. See FIG. 5. The combustion chamber 124 has a first open end 144 and a second closed end 146. See also, FIG. 4.

The housing 122 may define the chamber 124 through a number of different possible structures. In general terms, the housing 122 may include a wall 150 that is in the form of a generalized cylinder having a simple closed curve cross-section with a portion of the curve defining a straight line. See FIG. 6. Although the wall 150 is in the shape of a generalized cylinder that may be described as a having a longitudinal axis 152 (FIG. 4) that is orthogonal or at right angles to the wall 114 (or at least a surface 116 of the section 118 of the wall 114) (FIG. 1), this need not be the case in regard to every embodiment of the present disclosure. Furthermore, while the simple closed curve includes but a single straight line section, the curve may include other linear sections as well.

As one such example of the curve, the wall 150 of FIG. 6 illustrates a cross-section having an arcuate portion 156 and a straight portion 158, the arcuate portion 156 defined by the upstream and downstream edges 130, 132 of the housing 122, and the straight portion 158 disposed between the upstream and downstream edges 130, 132. In regard to the particular embodiment illustrated, the arcuate portion 156 is defined along a circle (C) and the straight portion 156 is defined along a chord (Ch) of the circle (C). It will be recognized that the illustrated embodiment is but one embodiment of the housing 122 and chamber 124 according to the present disclosure.

It will be recognized that the chamber 124 according to the embodiment illustrated in FIGS. 4-6 may also be defined by an outer wall of circular cylindrical shape (i.e., cylindrical with a circular cross-section) with a flat plate disposed within the outer wall along a chord of the circular cross-section of the outer wall. The combination of these elements would define a chamber 124 shaped much like that illustrated in FIGS. 4-6. However, this combination of elements would also define an internal air space not in communication with the slot 134. The air in the space would effectively be trapped in the space so defined, and create an insulated pocket. It may be more difficult to dissipate heat from this portion of the burner assembly 106 because of the insulating air space, which may lead to premature wear and failure of this portion of the burner assembly 106 (in particular, the flat plate) relative to the remainder of the assembly 106. However, a structure so defined as to produce the chamber 124 would still be considered to be within the scope of the present disclosure, albeit perhaps operationally inferior to other embodiments.

As mentioned above, the burner head assembly 126 is disposed in the combustion chamber 124. In particular, the burner head assembly 126 may have a first end 170 coupled to the blower assembly 120 and a second end 172 disposed within the combustion chamber 124. See FIG. 7. As illustrated, the elongated burner assembly 126 depends into the first end 144 of the chamber 124 and extends along the chamber 124 between the first and second ends 144, 146 of the chamber 124. See FIG. 2. In fact, as illustrated in FIG. 2, the assembly 126 may depend from the first end 144 of the chamber 124 to the second end 146 of the chamber 124 with only a small gap between the second end 172 of the burner head assembly 126 and the second end 146 of the chamber 124, relative to the lengths of the housing 122/chamber 124 and the burner head assembly 126.

According to an embodiment of the present disclosure, the burner head assembly 126 comprises a fiber burner head. As illustrated in FIG. 7, the burner head assembly 126 may have a circular cylindrical shape (i.e., cylindrical with a circular cross-section) between the first and second ends 170, 172. Other burner head assemblies 126 may be used. However, it is believed that the fiber burner head will permit the low-flame combustion necessary to provide low NOx emissions in the exhaust stream passing through the slot 134 in the downstream edge 132 of the housing 122.

There is a considerable degree of variation possible in the placement of the burner head assembly 126 relative to the housing 122 and the chamber 124. For example, the elongated housing 122 may have a longitudinal axis 152 and the elongated burner head assembly 126 may have a longitudinal axis. According to certain embodiments, the burner head assembly 126 may be disposed within the elongated housing 122 with longitudinal axis of the burner head assembly 126 and the longitudinal axis of the housing 122 collinear, as is illustrated in FIGS. 2, 5 and 6. According to such an embodiment, the surface of the burner head assembly 126 may be closer to an inner surface of the straight portion 158 of the wall 150 of the housing 122 than to the arcuate portion 156 of the wall 150. Alternatively, the burner head assembly 126 may be disposed within the elongated housing 122 with longitudinal axis of the burner head assembly 126 and the longitudinal axis of the housing 122 parallel to each other. The offset relationship between the axes may permit the burner head assembly 126 to be disposed within the chamber 124 to permit a more equal distribution of the space around the burner head assembly 126 within the chamber 124.

Finally, as also mentioned above, the blower assembly 120 is attached to the burner head assembly 126. The blower assembly 120 is illustrated in part in FIG. 8, with particular emphasis on those elements of the blower assembly 120 that are used to combine the air and fuel and to introduce those components into the burner head assembly 126. Consequently, certain elements of the blower assembly 120 are described, but not illustrated, although their structure, placement and function would be apparent to one skilled in the art.

The blower assembly 120 includes at one end a motor-driven blower 180 of conventional nature, to which is attached a blower adapter plate 182. Sandwiched between the blower adapter plate 182 and an injector plate 184 is a swirl plate 186 having a plurality of blades, plates or fins. The blower adapter plate 182, the injector plate 184 and the swirl plate 186 are secured together through the use of fasteners.

Attached to the injector plate 184 is an injector flange 188. Disposed between the injector plate 184 and the injector flange 188 is a gas orifice 190 and an o-ring 192, the o-ring 192 being disposed radially outwardly of the gas orifice 190. The injector plate 184 and the injector flange 188 are secured together through the use of fasteners, with the gas orifice 190 received in a receptacle 194 bounded by surfaces of the injector plate 184 and the injector flange 188 and the o-ring 192 disposed in an annular groove 196 formed in the injector flange 188. The o-ring 192 seals the receptacle 194 along the interface between the injector plate 184 and the injector flange 188.

As seen with reference to FIG. 3, a housing 200 is disposed about the blower adapter plate 182, injector plate 184, and swirl plate 186. The housing 200 has an inlet 202 through which gases (e.g., air) may enter the housing 200. The air entering the housing 200 mixes with fuel entering through the gas orifice 190 at the swirl plate 186 before being introduced into the blower 180. The air enters about the periphery of the swirl plate 186 while the fuel enters along the center of the swirl plate 186, the resulting fuel/air mixture being drawn into the blower 180 and introduced into the burner head assembly 126.

The burner assembly 106 may be used to heat air moved through the conduit 102 by the blower 104 in the following manner.

To begin, air is drawn into the housing 200 through the inlet 202 (see FIG. 3) by the action of the blower 180. At the same time, fuel (e.g., gas) may be drawn into the housing through the gas orifice 190. The air and fuel are mixed as they pass through the swirl plate 186 sandwiched between the blower adapter plate 182 and the injector plate 184. The fuel/air mixture is then drawn into the blower 180 and passed into the burner head assembly 126, where it is burned or combusted.

As mentioned previously, a low-flame, low NOx emission combustion is possible at the burner head assembly 126 through the combination of the housing 122 with the burner head assembly 126. The flame of the burner head assembly 126 heats the air in the chamber 124, which also mixes with the heated gases produced by combustion of the fuel/air mixture at the burner heat assembly 126. The flame of the burner head assembly 126 may also, directly or indirectly, heat the wall 150 of the housing 122.

As the air passes through the conduit 102 between the first end 110 and the second end 112, it passes over, under and around the burner assembly 106. As such, heat is transferred from the burner assembly 106, and in particular the wall 150 of the housing 122 of the burner assembly 106, to the air in the conduit 102. This increases the heat of the air in the conduit 102. In addition, the heated air and exhaust products from the burner assembly 106 exit through the slot 134 in the downstream edge 132, and are mixed with the air in the conduit 102, thereby increasing the temperature of the air in the conduit 102 as well.

As was recognized above, the burner assemblies and systems according to the present disclosure may have one or more advantages relative to conventional technology, any one or more of which may be present in a particular embodiment in accordance with the features of the present disclosure included in that embodiment. The burner assembly may provide a low NOx emission through the use of low-flame combustion. The burner assembly may also minimize disruption of the air flow about the burner assembly, and through the associated conduit, thereby minimizing the pressure drop within the conduit. Further, the burner assembly may minimize the noise produced by the burner assembly through the use of a housing of the shape and characteristics described above.

Other advantages not specifically listed herein may also be recognized as well. Moreover, still other variants and alternatives are possible.

We claim:

1. A burner assembly comprising:

a blower assembly couplable to a source of fuel;

a longitudinally elongated housing having a first lateral edge, a second, opposite lateral edge, and a slot formed in the second edge, the housing with a wall enclosing a combustion chamber, the chamber having a constant cross-section taken normal to the longitudinal direction, the cross-section having an arcuate portion defined along a circle and a straight portion defined along a chord of the circle, the arcuate portion defined by the first and second lateral edges of the housing wall and the straight portion defined by the housing wall disposed between the first and second edges, the slot being disposed at a right angle to the straight portion as viewed along the longitudinal direction; and a longitudinal elongated burner head assembly, the elongated burner head assembly having a first end coupled to the blower assembly, a second end longitudinally-spaced from the first end, disposed within the combustion chamber and spaced from the housing, and a circular cylindrical shape between the first and second ends, the elongated housing has a longitudinal axis and the elongated burner head assembly has a longitudinal axis, the elongated burner head assembly disposed within the elongated housing with the longitudinal axes of the housing and the burner head assembly collinear with each other.

2. The burner assembly according to claim 1, wherein the chamber has a first open end and a second closed end, and the elongated burner assembly extends into the first end of the chamber and extends along the chamber between the first and second ends of the chamber.

3. The burner assembly according to claim 1, wherein the burner head assembly comprises a fiber burner head.

4. A system for heating air, comprising:

a conduit having a first end and a second end;

a blower in communication with the conduit to move air along the conduit between the first end and the second end; and a burner assembly disposed within the conduit between the first and second ends of the conduit, the burner assembly comprising:

a blower assembly coupled to a source of fuel;

a longitudinally elongated housing having a lateral upstream edge toward the first end of the conduit, a lateral downstream edge toward the second end of the conduit, and a slot formed in the downstream edge, the housing with a wall defining a combustion chamber, the chamber having a constant cross-section taken normal to the longitudinal direction, the cross-section having an arcuate portion defined along a circle and a straight portion defined along a chord of the circle, the arcuate portion defined by the upstream and downstream edges of the housing wall and the straight portion defined by the housing wall disposed between the upstream and downstream edges; and a longitudinal elongated burner head assembly, the elongated burner head assembly having a first end coupled to the blower assembly, a second end longitudinally-spaced from the first end, disposed within the combustion chamber and spaced from the housing, and a circular cylindrical shape between the first and second ends, the elongated housing has a longitudinal axis and the elongated burner head assembly has a longitudinal axis, the elongated burner head assembly disposed within the elongated housing with the longitudinal axes of the housing and the burner head assembly collinear with each other.

5. The system for heating air according to claim 4, wherein the chamber has a first open end and a second closed end, and the elongated burner assembly extends into the first end of the chamber and extends along the chamber between the first and second ends of the chamber.

6. The system for heating air according to claim 4, wherein the burner head assembly comprises a fiber burner head.

* * * * *